US009638454B2

(12) United States Patent
Klingshirn et al.

(10) Patent No.: US 9,638,454 B2
(45) Date of Patent: May 2, 2017

(54) REFRIGERATION APPLIANCE

(71) Applicant: BSH BOSCH UND SIEMENS HAUSGERÄTE GmbH, München (DE)

(72) Inventors: Astrid Klingshirn, Zusmarshausen (DE); Immanuel Ring, Bopfingen (DE); Markus Spielmannleitner, Ellwangen (DE)

(73) Assignee: BSH Hausgeräte GmbH, Munich (DE)

( * ) Notice: Subject to any disclaimer, the term of this patent is extended or adjusted under 35 U.S.C. 154(b) by 267 days.

(21) Appl. No.: 14/406,333

(22) PCT Filed: Jun. 7, 2013

(86) PCT No.: PCT/EP2013/061776

§ 371 (c)(1),
(2) Date: Dec. 8, 2014

(87) PCT Pub. No.: WO2013/186132

PCT Pub. Date: Dec. 19, 2013

(65) Prior Publication Data

US 2015/0323240 A1 Nov. 12, 2015

(30) Foreign Application Priority Data

Jun. 13, 2012 (DE) ..... 10 2012 209 937

(51) Int. Cl.
*F25D 17/06* (2006.01)

(52) U.S. Cl.
CPC ..... *F25D 17/065* (2013.01); *F25D 17/062* (2013.01); *F25D 2317/04131* (2013.01)

(58) Field of Classification Search
CPC ..... F25D 17/062; F25D 17/065; F25D 2317/04131
USPC ..... 62/187
See application file for complete search history.

(56) References Cited

U.S. PATENT DOCUMENTS

| | | | | |
|---|---|---|---|---|
| 2,543,494 | A | 2/1951 | Hartman | |
| 7,665,327 | B2 * | 2/2010 | Tunzi | F25D 17/065 62/408 |
| 2006/0021365 | A1 * | 2/2006 | Cushman | F25D 17/045 62/187 |

FOREIGN PATENT DOCUMENTS

| | | | | |
|---|---|---|---|---|
| CN | 1532495 | | 9/2004 | |
| CN | 1714265 | A | 12/2005 | |
| CN | 101356936 | | 2/2009 | |
| CN | 102313426 | | 1/2012 | |
| DE | 102007062004 | A1 * | 6/2009 | F25D 25/025 |
| JP | 5-196339 | | 8/1993 | |
| JP | 2009-121803 | | 6/2009 | |

(Continued)

OTHER PUBLICATIONS

International Search Report for PCT/EP2013/061776 mailed Sep. 16, 2013, 4 pages.

(Continued)

*Primary Examiner* — Marc Norman
(74) *Attorney, Agent, or Firm* — Nixon & Vanderhye P.C.

(57) ABSTRACT

A refrigeration appliance, particularly a household refrigeration appliance, has a storage space for cooled material, wherein at least one passage for the flow of air into and out of the storage space is formed in a wall delimiting the storage space. The passage can be closed by a movable closure element. A fan for driving an air flow is arranged in the storage space and can be operated with the passage closed.

22 Claims, 3 Drawing Sheets

(56) References Cited

FOREIGN PATENT DOCUMENTS

| | | |
|---|---|---|
| WO | WO 2004/038311 A1 | 5/2004 |
| WO | WO 2007/052208 | 5/2007 |

OTHER PUBLICATIONS

Written Opinion of the ISA for PCT/EP2013/061776 mailed Sep. 16, 2013, 5 pages.
International Preliminary Report on Patentability for PCT/EP2013/061776 dated Sep. 1, 2014, 17 pages.

* cited by examiner

REFRIGERATION APPLIANCE

This application is the U.S. national phase of International Application No. PCT/EP2013/061776, filed 7 Jun. 2013, which designated the U.S. and claims priority to DE Patent Application No. 10 2012 209 937.9, filed 13 Jun. 2012, the entire contents of each of which are hereby incorporated by reference.

The present invention relates to a refrigeration appliance, in particular a household refrigeration appliance, which is particularly suitable for storing chilled goods that are susceptible to drying out. The shelf life of food that is not packaged in a sterile and air-tight manner in a refrigeration appliance is limited by microbial decay, chemical and enzymatic decay processes and by drying out. Fresh food such as fruit, vegetables, salads or fresh herbs give off moisture—in addition to the humidity released by natural respiration—to their environment until equilibrium is reached between them and the ambient air. The associated drying out of such foods is generally irreversible and results in said food being judged to be no longer fit for consumption long before consumption is actually questionable in respect of health due to possible colonization by micro-organisms. In order to be able to store fresh food for a long time in a refrigeration appliance while still maintaining its quality, it is therefore desirable to minimize evaporation. Storage with too high a level of air humidity must also be avoided, as this in turn would promote the growth of micro-organisms to a significant degree.

A refrigeration appliance according to the preamble of claim 1 is known from DE 101 61 306 A1. With this no-frost refrigeration appliance a user is able to operate a fan, which circulates air between a storage space and an evaporator chamber, and a compressor, which supplies the evaporator with liquid refrigerant, at different times. If said user observes condensation in the storage space, he/she can prevent moisture being transported back from the evaporator into the storage space by keeping the evaporator at a low temperature even when the fan is not operating. Conversely, if said user ascertains that chilled goods are drying out excessively in the storage space, he/she can leave the fan running while the evaporator is not cooling, in order thus to evaporate air humidity deposited on the evaporator once again and convey it back into the storage space. The effectiveness of this approach is limited in that in practice the rate at which moisture is released in the storage space varies with the nature and quantity of the chilled goods accommodated therein and it is therefore almost impossible for a user to find a setting that guarantees a good storage climate all the time. Instead the problem arises that a high level of air humidity that is desirable per se increases the risk of condensed water being deposited at a particularly cool point in the storage space. Also the constant switching between on and off phases of the compressor and fan results in fluctuations in the air humidity in the storage space, with minimum air humidity values always occurring at the end of a common compressor and fan operating phase. The moisture previously present in the air of the storage space is now firmly bound at the evaporator and the moisture required to restore the equilibrium between the air of the storage space and the food stored therein is primarily given off by the food, resulting in premature decay.

The object of the invention is to create a refrigeration appliance which can offer improved storage conditions for fresh moisture-emitting chilled goods.

The object is achieved in that in a refrigeration appliance, in particular a household refrigeration appliance, with a storage space for chilled goods, which has at least one passage for the flow of air into and/or out of the storage space in a wall delimiting the storage space, and a fan for driving an air flow in the storage space, the passage can be closed by a movable closure element and the fan is arranged in the storage space and can be operated when the passage is closed. The fan allows local temperature and humidity differences in the storage space to be minimized without the air circulated by it being able to leave the storage space by way of the passage. The air humidity can therefore be kept constant at a high value with the risk of condensed water forming in the storage space.

So that the air circulation driven by the fan does not in turn promote the drying out of the chilled goods, the fan should be arranged and dimensioned in such a manner that the speed of the air flow in the storage space does not exceed 2 m/sec anywhere.

A control unit should be set up to control the closure element based on the air humidity present in the storage space, in order to allow the emission of moist air from the storage space if this is necessary to prevent condensed water forming in the storage space.

The control unit should therefore expediently be set up in such a manner as to open the passage when the air humidity exceeds a limit value at least one measuring point in the storage space.

The control unit can also serve to control the fan itself based on the air humidity present in the storage space, preferably in such a manner that the control unit brings the fan into operation when the difference between the air humidity and/or the temperature at two measuring points in the storage space exceeds a limit value.

The storage space is preferably not cooled or in any case is only cooled to a small degree by the inflow of cold air from the outside but is instead cooled by contact between its wall and a refrigeration reservoir. Such contact can be very large in area and can allow cooling of the storage space when the temperature difference between the storage space and refrigeration reservoir is small. The smaller this temperature difference, the smaller too the tendency for temperature gradients to form in the storage space, which would have to be eliminated again by operating the fan.

According to one preferred embodiment the storage space is a container and the refrigeration reservoir is a storage compartment of the refrigeration appliance, in which the container is arranged.

In order to be able to handle chilled goods in a convenient manner in the container, it is expedient if the container has at least one lower and one upper container part and the lower container part can be moved without the upper container part, in particular can be removed from the storage compartment.

Components, which have to be connected to energy supply or signal lines for their operation, for example the closure element, the fan or a sensor, are preferably provided on the upper container part.

The storage compartment can for its part have a second fan in order to drive an air flow in the storage compartment, said air flow washing around the container and thus ensuring a regular temperature distribution on the container wall.

If the refrigeration appliance is a no-frost appliance the fan that conventionally drives the exchange of air between the storage compartment and an evaporator chamber in an appliance of this type can expediently serve as the second fan.

If an evaporator, which cools the storage compartment, is provided with a defrosting heater, the control unit can be set up to keep the passage closed, while the defrosting heater is in operation, thus preventing the entry of relatively warm moist air into the interior of the container during defrosting.

In order to minimize temperature fluctuations and their associated fluctuations in relative air humidity in the storage space, the wall of the storage space can be provided with a heat storage medium on at least part of its surface. In order to be able to store a large quantity of heat in a small quantity of the heat storage medium, the heat storage medium is expediently selected in such a manner that a phase transition temperature of the heat storage medium corresponds to the operating temperature of the refrigeration reservoir. The heat storage medium is preferably arranged on a part of the wall that is exposed to a cold air flow driven by the second fan.

A further measure that can be used to minimize temperature gradients and fluctuations in the storage space is for the wall to comprise an outer wall, an inner wall and an insulating gap in between at least on part of its surface.

Further features and advantages of the invention will emerge from the description which follows of exemplary embodiments with reference to the accompanying figures. Features of the exemplary embodiments that are not mentioned in the claims will also emerge from this description and the figures. Such features can also occur in combinations other than those disclosed specifically here. The fact that a number of such features are mentioned together in the same sentence or some other textual context therefore does not justify the conclusion that they can only occur in the specifically disclosed combination; rather it should in principle be assumed that of a number of such features some can be omitted or modified, as long as this does not call into question the functionality of the invention.

Figure 1:
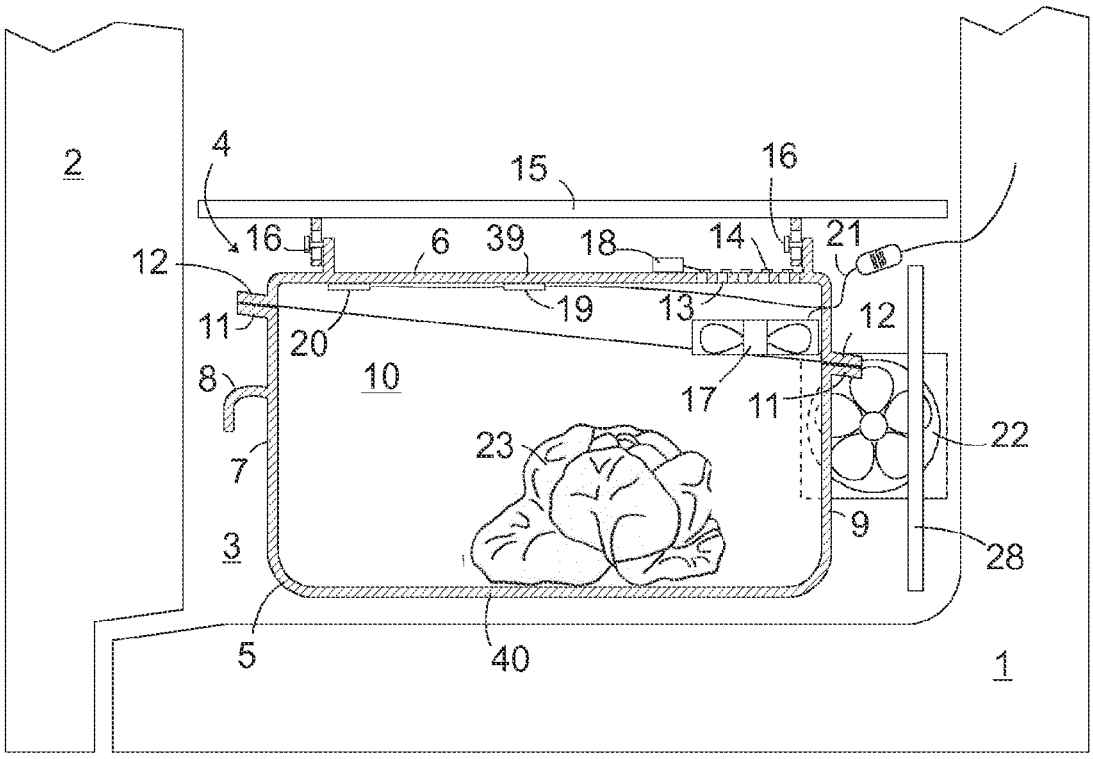
FIG. 1 shows a schematic section through a household refrigeration appliance according to a first embodiment of the invention.

FIG. 1 shows a schematic section through a household refrigeration appliance with a carcass 1 and a door 2, which enclose a chilled storage compartment 3, in particular a zero degree or fresh food chiller compartment. Further storage compartments that may be closed using a different door from the illustrated door 2, for example a standard chiller compartment and a freezer compartment, may be present.

A container 4 injection molded for example from plastic and accommodated in the storage compartment 3 comprises a lower container part 5 and an upper container part 6. The lower container part 5 is positioned on the base of the storage compartment 3 in such a manner that it can be moved in a depthwise direction. It comprises a front wall 7 facing the door 2 with a handle 8 molded on to facilitate handling, a rear wall 9, which is less high than the front wall 7, and side walls 10, the upper edges of which drop continuously from the front wall 7 to the rear wall 9. Formed along the upper edges of the walls 7, 9, 10 is a sealing flange 11 that drops at an angle to the rear. A complementary sealing flange 12 of the upper container part 6 rests on the sealing flange 11. The contact between the flanges 11, 12 does not have to be hermetically sealed but any gap between them should be so narrow that the air circulation through such a gap is small compared with that through a passage 13 (made up of a number of slits here) formed in the upper container part 6, when it is exposed by a closure element arranged thereon, in this instance a grid 14 that can be moved in the depthwise direction.

The upper container part 6 is suspended from a ceiling 15 of the storage compartment 3 with vertical play, e.g. with the aid of hooks 16 engaging in extended holes, to allow close contact between the sealing flanges 11, 12 even if the container parts 5, 6 are not positioned precisely above and below one another.

Fitted on the upper container part 6 are a fan 17, a control element 18 engaging with the grid 14, an air humidity sensor 19 and in some instances also a temperature sensor 20. The fan 17, the control element 18 and the sensors 19, 20 are connected by way of a line cluster 21 to an electronic control unit (not shown here) of the refrigeration appliance which, in addition to controlling the fan 17 and the control element 18 based on measurement data from the sensors 19, 20, is also responsible for controlling a second fan 22 arranged on the storage compartment 3 outside the container 4 and, in the conventional manner, a compressor (not shown here) of the refrigeration appliance.

The fan 17 and control element 18 can be controlled by the control unit in different ways. In the simplest instance the fan 17 operates continuously to maintain an air flow circulating slowly at less than 2 m/s in the container 4, preventing or reducing the formation of a temperature and air humidity gradient within the container 4 and thus ensuring that the air humidity value detected by the air humidity sensor 19 locally at its installation point is representative of the entire volume of the container 4. If this value exceeds an upper limit of for example 85%+$\epsilon$rH, where $\epsilon$ is a small positive value, e.g. 0.5%, the control unit prompts the control element 18 to open the passage 13. As this means that moist air is blown out of the container 4 into the surrounding storage compartment 3 and drier air flows back from there into the container 4, the air humidity therein is lowered sufficiently to prevent condensation being deposited within the container 4. When the value measured by the sensor 19 drops to 85%−$\epsilon$, the control element 18 is again prompted to close the passage 13. The air humidity in the container 4 therefore varies within a very narrow interval of 2$\epsilon$ and the quantity of moisture given off by the chilled goods 23 stored in the container 4 to maintain air humidity equilibrium is very small.

When the passage 13 is open the power of the fan 17 can be increased to achieve a fast exchange of air between container 4 and storage compartment 3 and to be able to close the passage 13 again quickly.

Figure 3:
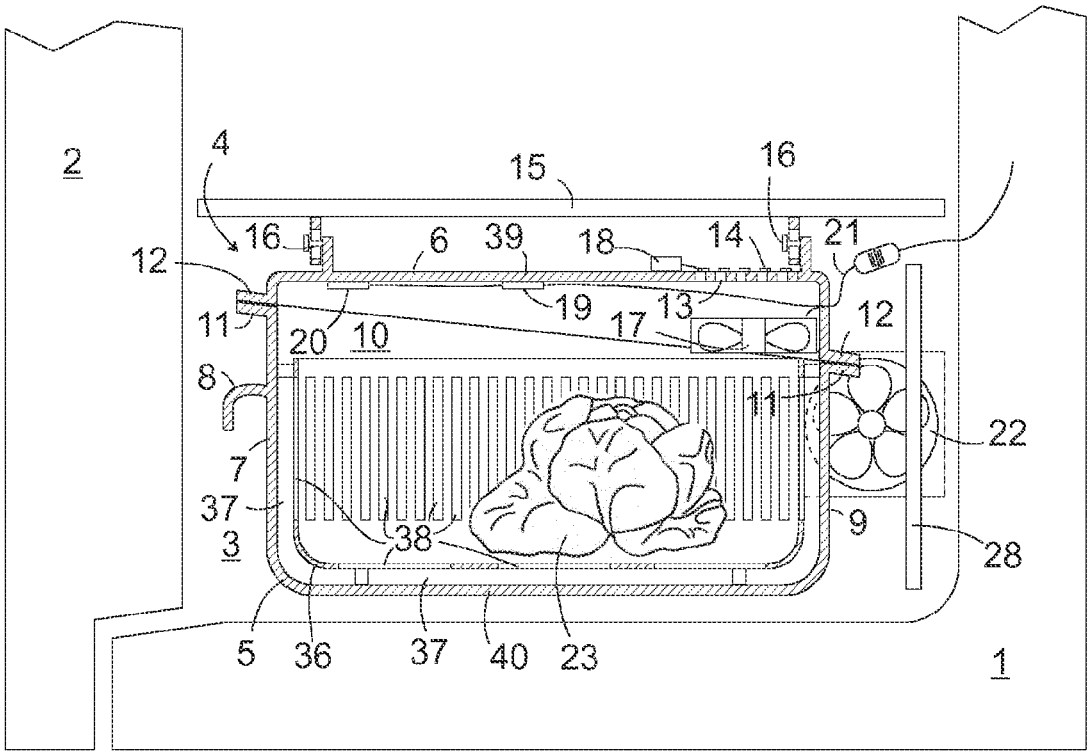
FIG. 3 shows a section according to a third embodiment of the invention.

The on limit value for air humidity can of course also be set at values other than the abovementioned 85% rH. The limit value should always be higher than the equilibrium air humidity of the chilled goods 23 but should also be far enough below 100% rH to be able to exclude the formation of condensation in relatively cool regions of the container 4 that may be shielded by chilled goods 23 from the air flow of the fan 17. In order to minimize the probability of such shielded regions occurring, a tray 36 can be arranged in the container 4, as shown in FIG. 3, at a distance from its walls and base, so that the air driven by the fan 17 can circulate in an intermediate space 37 between lower container part 5 and tray 36 and can pass through openings 38 in the tray and reach the chilled goods 23 from all sides.

According to one development operation of the fan 17 is also closely linked to need. Need-based operation of the fan 17 results when there is a clear temperature or air humidity gradient in the container 4. The existence of a temperature gradient can be concluded for example if the value measured by the temperature sensor 20 differs significantly from that of a temperature sensor (not shown in the figure), which is positioned in the manner known per se on a wall of the storage compartment 3 and serves to control compressor operation.

A temperature or air humidity gradient can of course also be measured directly at the container 4, if it has at least two sensors of the same type at different points. As on the one hand cold air tends to collect at the base of the container 4 and on the other hand the container 4 is primarily exposed to a heat inflow on its front face, while being cooled from the rear, a temperature or humidity gradient is most likely to form between a relatively cold or moist region in proximity to the base and rear wall of the container 4 and a relatively warm or dry region in a front upper corner of the container 4. A second sensor should therefore be at a vertical and/or depthwise distance from the sensors 19, 20 and should preferably be arranged on the lower container part 5, in particular on its rear wall 9.

If such a second sensor is permanently fitted on the lower container part 5 and this latter is to be able to be removed from the refrigeration appliance so that the chilled goods 23 can be handled, the problem arises of transmitting the signals from such a sensor to the control unit. In the embodiment shown in FIG. 2 this problem is resolved in that a large opening 24 is formed in the rear wall 9 of the—otherwise identical to the one in FIG. 1—lower container part 5, around which, when the container part 5 is not partially pulled out, as shown in the figure, but is positioned in a sealing manner below the upper container part 6, elastic bellows 25 rest in a sealing manner against the rear wall 9. Temperature and/or air humidity sensors 26, 27 fitted in these bellows 25 are fixed in relation to the carcass 1 and connected by way of fixed lines to the control unit but are exposed to the air in the container 4 when the door 2 is closed and the container parts 5, 6 are positioned one on top of the other in a sealing manner.

Figure 2:
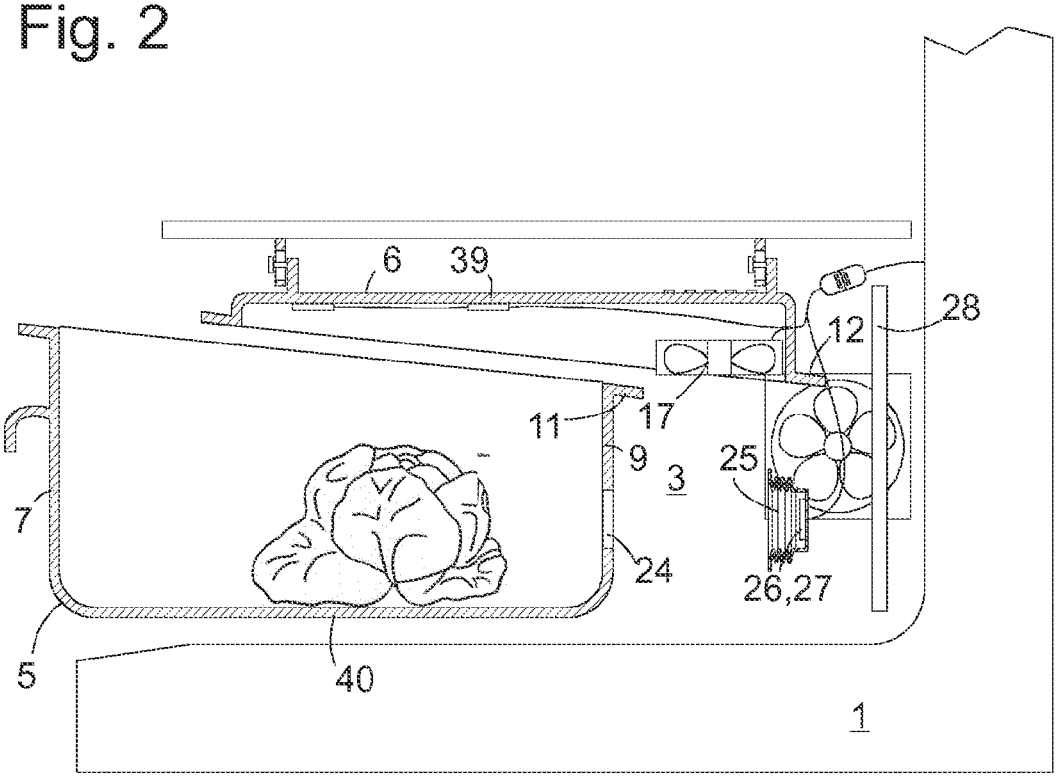
FIG. 2 shows a section through a household refrigeration appliance according to a second embodiment with the door open and the lower container part partially pulled out.
Figure 4:
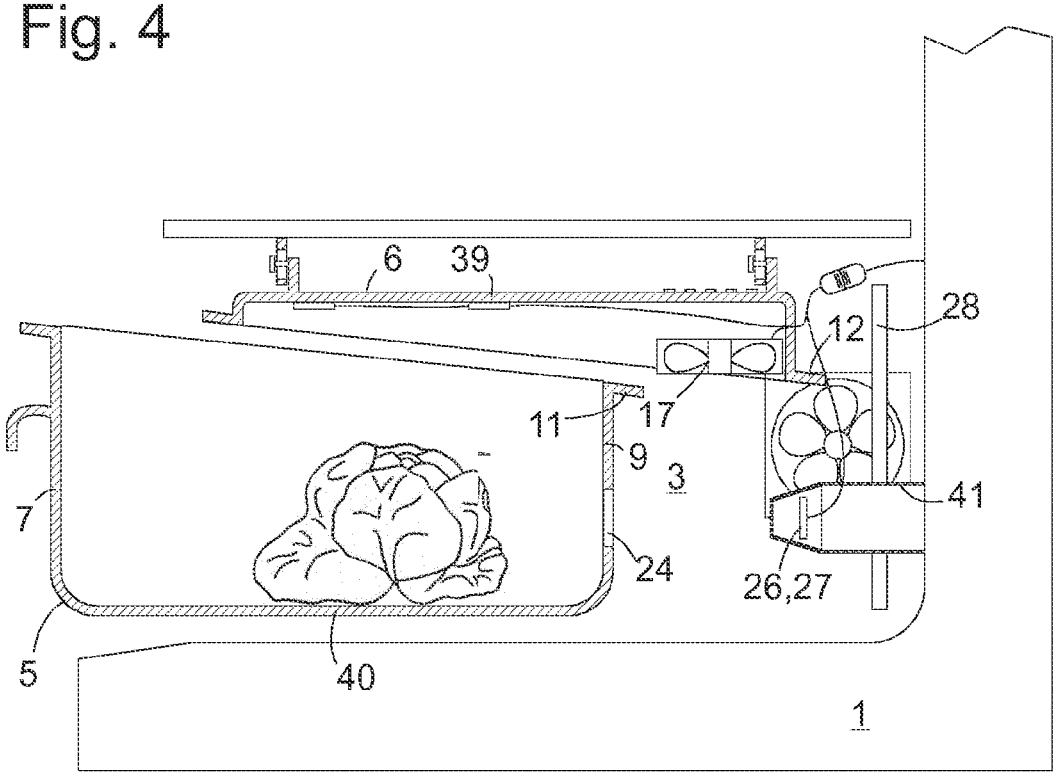
FIG. 4 shows a section according to a fourth embodiment.

As an alternative to the diagram in FIG. 2 the sensors 26, 27 can also be accommodated in a housing 41 fixed in the storage compartment 3, for example projecting from the rear wall 29, said housing 41 engaging in the opening 24 in the rear wall 9 when the container part 5 is pushed into the storage compartment 3. This housing 41, which is opened up at its tip that engages in the container 4, can taper toward the front, as shown in FIG. 4, so that it can be inserted easily and reliably into the opening 24 and a stop position, up to which the container 4 can be pushed into the storage compartment 3 and in which the opening 24 is essentially sealed, is defined by contact between the housing 41 and the edges of the opening 24.

Figure 5:
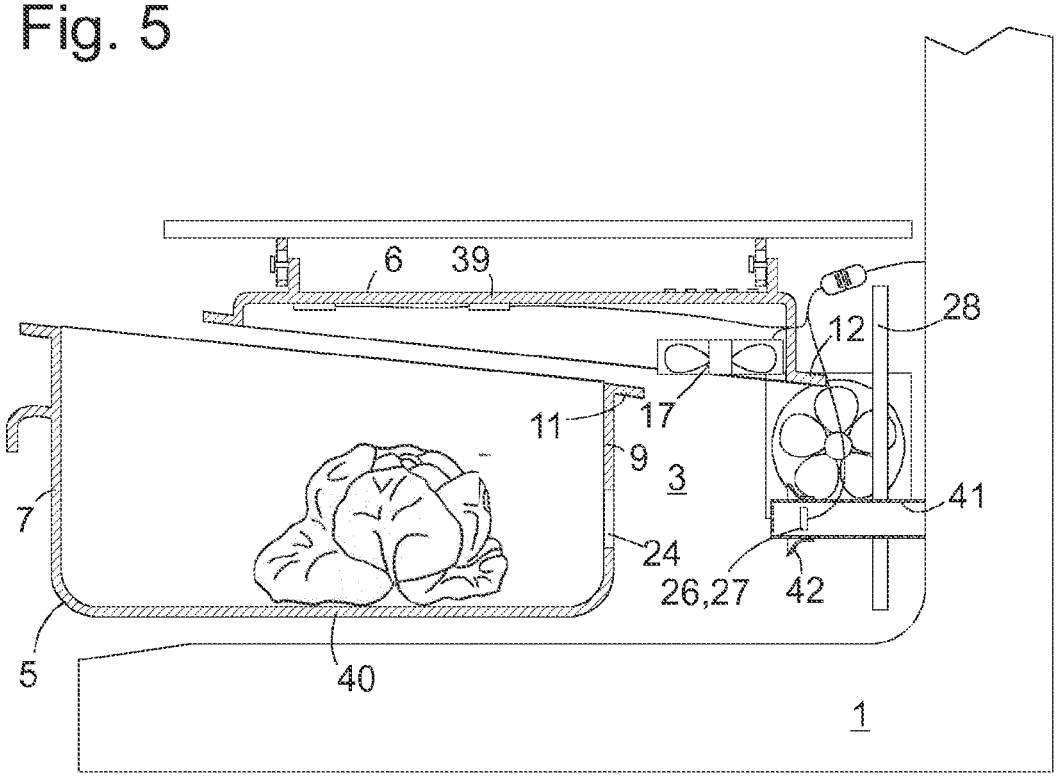
FIG. 5 shows a section according to a fifth embodiment.

According to a further alternative shown in FIG. 5 the housing 41 can be provided with a circumferential flexible skirt 42, made of rubber for example, which rests closely against the rear wall 9 in the pushed in position and seals the opening 24 even if the housing 41 itself does not touch the edges of the opening 24.

The presence of sensors 19, 20, 26, 27 for temperature and air humidity some distance away from one another in the direction of the temperature or humidity gradient allows for example the fan 17 to be controlled in such a manner that the fan 17 is always switched on when the difference between the air humidity values measured by the air humidity sensors 19, 27 exceeds a limit value of for example 4% rH or the difference between the values measured by the temperature sensors 20, 26 exceeds a limit value of 0.3 K and the fan is switched off again as soon as the values drop below both limit values.

In the embodiments in FIGS. 1 to 5 an evaporator 28 is arranged on the rear face of the storage compartment 3. The evaporator 28 here is shown some distance from the rear wall 29 of the carcass 1 but it could also be a cold wall evaporator as known per se, which is inserted between an inner container and an insulating layer of the rear wall 19. The fan 22 is arranged to drive air circulation along the free surface of the evaporator 28 and around the walls 7, 9, 10, ceiling 39 and base 40 of the container 4, thus ensuring minimization of the temperature gradient in the storage compartment 3 or in the container 4.

Figure 6:
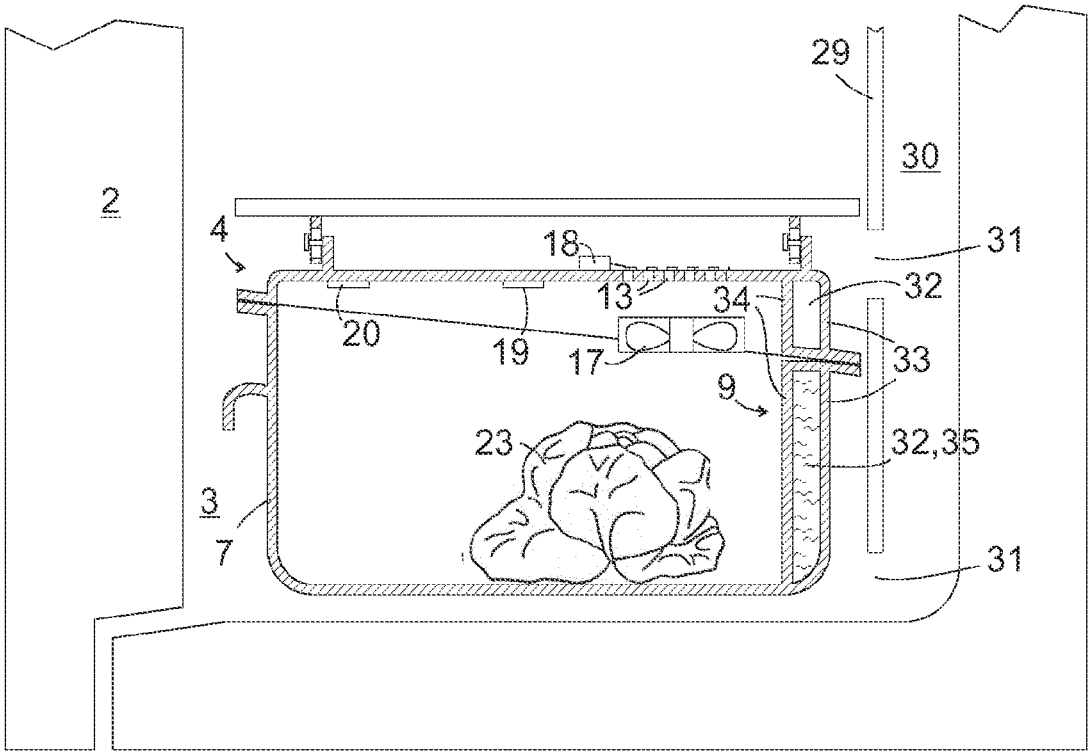
FIG. 6 shows a section according to a sixth embodiment of the invention.

Naturally a no-frost design is also possible, as shown for example in FIG. 6, where the evaporator and a fan assigned thereto are accommodated outside the illustrated region, for example in the known manner in an evaporator chamber below the ceiling of the carcass 1, and the fan drives a cold air flow along a duct 30 that passes by way of the rear wall 29 and exits by way of openings 31 in the rear wall 29 into the storage compartment 3. The cold air flows to the container 4, takes heat from it and rises along the inner face of the door 2 back in the direction of the evaporator chamber. In order with such a structure to avoid too fast cooling of the rear face of the container 4 exposed directly to the cold air flow, its rear wall 9 can have a double-walled structure. A gap 32 between an outer wall 33 and an inner wall 34 can be filled with air, as shown in the example of the upper container part 6, so that the insulating effect of the air prevents the inner wall 34 cooling too fast or the gap 32 can be filled, as shown in the example of the lower container part 5, with a heat-carrying material 35, for example a brine or a water/alcohol mixture, the freezing point of which is between a setpoint operating temperature of the storage compartment 3 and the temperature of the cold air exiting from the duct 30.

The evaporator of a no-frost refrigeration appliance is generally provided with a defrosting heater to thaw frost deposited on the evaporator during operation and to allow the condensation to flow away. When a defrosting operation has taken place, the compressor must run for a while before the evaporator chamber cools enough for all the condensation residues remaining there to have frozen again. If the fan of the evaporator chamber runs during this time, the moisture content of the air exiting at the openings 31 can exceed the limit value for the air in the container 4, which results in the opening of the passage 13. In such conditions the fact that the passage 13 is open would result not in a reduction but in an increase in air humidity in the container 4. Therefore in such a situation the monitoring of the air humidity in the container 4 is preferably suspended and the passage 13 remains closed regardless of the air humidity value in the container 4 until the evaporator chamber has cooled down again.

The invention claimed is:

1. A household refrigeration appliance comprising a container for chilled goods, said container being cooled by contact between its wall and a storage compartment, in which the container is arranged, with at least one passage which can be closed by a movable closure element for the exchange of air between the container and the storage compartment being formed in a wall delimiting the container, and a fan which is arranged in the container and can be operated when the passage is closed to drive an air flow in the container, wherein a control unit is set up to control the closure element and the fan based on the air humidity present in the container and wherein, when the passage is closed, the control unit is set to control the fan at an air flow speed to minimize localized temperature and humidity differences in the container, thereby allowing air humidity in the container to be maintained at a substantially constant value whilst reducing or preventing the risk of condensed water forming in the container and without excessively drying out the chilled goods.

2. The household refrigeration appliance as claimed in claim 1, wherein the speed of the air flow is not above 2 m/s.

3. The household refrigeration appliance as claimed in claim 1, wherein the control unit is set up to open the passage when the air humidity exceeds a limit value at at least one measuring point in the container, thereby releasing moist air from the container into the storage compartment and drier air to flow from the storage compartment to the container via the passage.

4. The household refrigeration appliance as claimed in claim 1, wherein the control unit is set up to bring the fan into operation when a gradient of the air humidity and/or the temperature derived from two measuring points in the container exceeds a limit value.

5. The household refrigeration appliance as claimed in claim 1, wherein the container comprises at least one upper and one lower container part and the lower container part is removable from the storage compartment while the upper container part remains fixed within the storage compartment.

6. The household refrigeration appliance as claimed in claim 5, wherein the closure element and the fan are provided on the upper container part.

7. The household refrigeration appliance as claimed in claim 6, wherein an air humidity sensor and a temperature sensor are provided on the upper container part.

8. The household refrigeration appliance as claimed in claim 1, wherein the storage compartment has a second fan and an air flow driven by the second fan washes around the container.

9. The household refrigeration appliance as claimed in claim 1, wherein an evaporator, which cools the storage compartment, is provided with a defrosting heater and the control unit is set up to keep the passage closed while the evaporator is heated.

10. The household refrigeration appliance as claimed in claim 1, wherein the wall has a heat storage medium on at least part of its surface.

11. The household refrigeration appliance as claimed in claim 1 the wall comprises an outer wall, an inner wall and a gap allowing air circulation between outer and inner walls on at least part of its surface.

12. A household refrigeration appliance, comprising:

a container for chilled goods that give off moisture as they decay, said container cooled by contact with a storage compartment in which the container is arranged, said container having at least one passage which is closable by a movable closure element for the exchange of air between the container and the storage compartment, the passage being formed in a wall delimiting the container;

a fan arranged in the container and operable when the passage is closed to drive air flow within the container; and a control unit to control the closure element and the fan based on air humidity present in the container, wherein the control unit is set to create humidity equilibrium in the container when the passage is closed by controlling the fan to generate air flow that substantially offsets moisture given off by the chilled goods, whereby the chilled goods are not excessively dried out and condensation in the container is reduced or prevented.

13. The household refrigeration appliance as claimed in claim 12, wherein a speed of the air flow is not above 2 m/s.

14. The household refrigeration appliance as claimed in claim 12, wherein the control unit is set up to open the passage when the air humidity exceeds a limit value at at least one measuring point in the container, thereby releasing moist air from the container into the storage compartment and drier air to flow from the storage compartment to the container via the passage.

15. The household refrigeration appliance as claimed in claim 12, wherein the control unit is set up to bring the fan into operation when a gradient of the air humidity and/or the temperature derived from two measuring points in the container exceeds a limit value.

16. The household refrigeration appliance as claimed in claim 12, wherein the container comprises at least one upper and one lower container part and the lower container part is removable from the storage compartment while the upper container part remains fixed within the storage compartment.

17. The household refrigeration appliance as claimed in claim 16, wherein the closure element and the fan are provided on the upper container part.

18. The household refrigeration appliance as claimed in claim 16, wherein an air humidity sensor and a temperature sensor are provided on the upper container part.

19. The household refrigeration appliance as claimed in claim 12, wherein the storage compartment has a second fan and an air flow driven by the second fan washes around the container.

20. The household refrigeration appliance as claimed in claim 12, wherein an evaporator, which cools the storage compartment, is provided with a defrosting heater and the control unit is set up to keep the passage closed while the evaporator is heated.

21. The household refrigeration appliance as claimed in claim 12, wherein part of the container has a heat storage medium on at least part of its surface.

22. The household refrigeration appliance as claimed in claim 12, wherein the container comprises an outer wall, an inner wall and a gap allowing air circulation between outer and inner walls on at least part of its surface.

* * * * *